US009038615B2

(12) United States Patent
Saunders

(10) Patent No.: US 9,038,615 B2
(45) Date of Patent: May 26, 2015

(54) SLINGSHOT BAIL GUARD

(71) Applicant: Charles A. Saunders, Columbus, NE (US)

(72) Inventor: Charles A. Saunders, Columbus, NE (US)

( * ) Notice: Subject to any disclaimer, the term of this patent is extended or adjusted under 35 U.S.C. 154(b) by 3 days.

(21) Appl. No.: 13/850,023

(22) Filed: Mar. 25, 2013

(65) Prior Publication Data

US 2013/0247894 A1 Sep. 26, 2013

Related U.S. Application Data

(60) Provisional application No. 61/615,315, filed on Mar. 25, 2012.

(51) Int. Cl.
*F41B 3/02* (2006.01)

(52) U.S. Cl.
CPC ..... *F41B 3/02* (2013.01)

(58) Field of Classification Search
CPC ..... F41B 3/02
USPC ..... 124/20.1, 20.2, 80
See application file for complete search history.

(56) References Cited

U.S. PATENT DOCUMENTS

| | | | | | |
|---|---|---|---|---|---|
| 1,606,609 | A * | 11/1926 | Wheeler, Jr. | ..... | 124/20.1 |
| 2,672,857 | A * | 3/1954 | Gauthier | ..... | 124/20.1 |
| 3,511,221 | A * | 5/1970 | Saunders | ..... | 124/20.1 |
| 3,749,075 | A * | 7/1973 | Saunders | ..... | 124/20.1 |
| 3,812,834 | A * | 5/1974 | Saunders | ..... | 124/20.1 |
| 3,865,094 | A * | 2/1975 | Sweeney | ..... | 124/20.1 |
| 3,875,923 | A * | 4/1975 | Horel | ..... | 124/20.1 |
| 3,901,209 | A * | 8/1975 | Woolsey et al. | ..... | 124/20.1 |
| 3,918,427 | A * | 11/1975 | Turner | ..... | 124/20.3 |
| 4,250,861 | A * | 2/1981 | Ellenburg | ..... | 124/20.1 |
| 4,265,212 | A * | 5/1981 | Wolf | ..... | 124/20.1 |
| 4,373,503 | A * | 2/1983 | Saunders | ..... | 124/20.1 |
| 4,458,658 | A * | 7/1984 | Blair | ..... | 124/20.1 |
| 4,583,513 | A * | 4/1986 | Ellenburg et al. | ..... | 124/20.2 |
| 4,911,136 | A * | 3/1990 | Brown | ..... | 124/20.1 |
| 4,922,884 | A * | 5/1990 | Ford | ..... | 124/20.1 |
| 5,224,703 | A * | 7/1993 | Osher | ..... | 473/513 |
| 5,230,323 | A * | 7/1993 | Saunders et al. | ..... | 124/20.1 |
| 5,279,276 | A * | 1/1994 | Nagel et al. | ..... | 124/20.1 |
| 5,345,922 | A * | 9/1994 | Ott | ..... | 124/20.1 |
| 5,501,207 | A * | 3/1996 | Black | ..... | 124/20.1 |
| 5,619,978 | A * | 4/1997 | Flournoy | ..... | 124/20.1 |
| 5,803,067 | A * | 9/1998 | Ellenburg et al. | ..... | 124/20.1 |
| 5,894,672 | A * | 4/1999 | Ellenburg et al. | ..... | 33/265 |
| 6,053,156 | A * | 4/2000 | Boon | ..... | 124/20.1 |
| 6,209,531 | B1 * | 4/2001 | Boon | ..... | 124/20.1 |
| 6,286,495 | B1 * | 9/2001 | Brown | ..... | 124/20.1 |
| 6,823,855 | B2 * | 11/2004 | Omi | ..... | 124/20.1 |
| 6,968,835 | B2 * | 11/2005 | Lee | ..... | 124/20.1 |
| 7,107,979 | B2 * | 9/2006 | Mitchell | ..... | 124/20.1 |
| 7,484,505 | B1 * | 2/2009 | Saunders | ..... | 124/20.1 |
| 7,506,642 | B2 * | 3/2009 | Edwards | ..... | 124/20.1 |
| 7,748,369 | B2 * | 7/2010 | Chee | ..... | 124/20.3 |
| 7,823,571 | B2 * | 11/2010 | Williamson et al. | ..... | 124/20.1 |

(Continued)

*Primary Examiner* — Melba Bumgarner
*Assistant Examiner* — Alexander Niconovich
(74) *Attorney, Agent, or Firm* — Levenfeld Pearlstein, LLC

(57) ABSTRACT

A bail guard for use with arm- or wrist-braced slingshots is disclosed. The bail comprises a thin, slightly arcuate body having upper and lower channels disposed on opposing sides, each upper and lower channel separated by a groove formed therebetween. The channels are dimensioned to receive and fictionally engage the distal ends of the arm or wrist brace of a slingshot such that the bail guard can be securely and removably mounted to the arm or wrist brace of the slingshot.

20 Claims, 18 Drawing Sheets

(56) References Cited

U.S. PATENT DOCUMENTS

| | | | | |
|---|---|---|---|---|
| 7,827,977 | B2 * | 11/2010 | Saunders | 124/20.1 |
| 7,900,620 | B1 * | 3/2011 | Walters et al. | 124/20.1 |
| 8,025,047 | B2 * | 9/2011 | Saunders | 124/20.1 |
| 8,302,318 | B2 * | 11/2012 | Saunders | 33/227 |
| 8,347,868 | B2 * | 1/2013 | Saunders | 124/20.1 |
| 8,640,682 | B2 * | 2/2014 | Shirk, II | 124/20.1 |
| 8,695,576 | B2 * | 4/2014 | Zadra | 124/20.1 |

* cited by examiner

SLINGSHOT BAIL GUARD

BACKGROUND OF THE INVENTION

The present invention relates generally to slingshots and their components and, more particularly, to a slingshot bail guard for use with arm- or wrist-braced slingshots.

Slingshots commonly are used for recreation and for hunting. Although slingshots have existed for centuries, the basic design and mechanics have remained constant over time. Quite simply, a traditional slingshot comprises a handle and a pair of arms extending divergently upward from the handle. An elastic band is attached between the arms. Typically, centered on the elastic band is a pouch designed to hold a projectile.

After a projectile is placed in the pouch, the pouch is pulled backwards, away from the arms, thereby extending and stretching the elastic band to create potential energy. When the pouch is released, the potential energy of the elastic band is transformed to kinetic energy, which is transferred to the projectile through the pouch. The projectile then is thrust forward, out of the pouch, and away from the slingshot user and toward a desired target.

Various design enhancements have been made over the years in an attempt to improve the functionality and performance of slingshots. For example, such improved slingshot devices include arm and wrist braces to help stabilize shots, foldable designs to make the slingshot devices more portable, aiming mechanisms to improve accuracy, multi-band designs to improve band life and increase shot speed and pulley assemblies to produce maximum projectile velocity with minimum force exertion by the user.

One such improved slingshot design is disclosed in U.S. Pat. No. 5,230,323 to Saunders et al., the disclosure of which is fully incorporated herein by reference. Saunders discloses an arm-braced slingshot having a handle, a hook assembly, a pair of elastic bands, a pouch, an arm brace and a retaining clip. The arm brace comprises a generally U-shaped collar having an intermediate yoke portion that is dimensioned to be received in a peripheral recess of the handle. The distal ends of the collar (that is, the arms of the collar that extend rearwardly from the handle) are provided with an arm strap extending therebetween that extends over the user's forearm when the handle is gripped in the normal manner during use of the slingshot.

The slingshot disclosed in Saunders has been updated and improved over time with respect to the types of bands, pooches and connection mechanisms used with the slingshot. Modern variations of the Saunders slingshot design utilize flat bands, quick-snap band connection/replacement mechanisms and engineered pouch designs, among other features. However, the design of the arm brace generally has remained the same.

That is, the arm brace still generally comprises a generally U-shaped collar, generally formed of a shaped cylindrical metal rod, where the distal ends of the collar are provided with an arm strap extending therebetween, which extends over the user's forearm when the handle is gripped in the normal manner during use of the slingshot. In this configuration, the portion of the user's arm disposed between the distal ends of the collar is exposed during use of the slingshot. Thus, when the slingshot it used, it is possible that the pouch and/or band may contact the exposed area of the user's arm during use.

What is needed, therefore, is a bail guard configured to attach to the arm or wrist brace of a slingshot to cover the exposed area of the user's arm during use of the slingshot. Preferably, the bail guard is removable. More preferably, the bail guard can be attached and removed without the need for tools. More preferably still, the bail guard is lightweight and compact and is adaptable for use across a wide variety of arm- and wrist-braced slingshots. The present invention satisfies this need.

BRIEF SUMMARY OF THE INVENTION

The present invention comprises a bail guard, for use with arm- and wrist-braced slingshots.

Specifically, the bail guard of the present invention comprises a thin, slightly arcuate body having upper and lower channels disposed, on opposing sides of the body, each upper and lower channel separated by a groove formed therebetween. The channels are dimensioned to receive and frictionally engage the distal ends of the arm or wrist brace of a slingshot such that the bail guard can be securely and removably mounted to the arm or wrist brace of the slingshot.

The bail guard is formed such that the respective upper channels, the respective lower channels and the respective grooves are disposed on opposing sides of the bail guard body from one another. That is, the upper channels are opposite from one another across the width of the bail guard, the grooves are opposite from one another across the width of the bail, guard and the lower channels are opposite from one another across the width of the bail guard.

In the disclosed embodiment, the upper and lower channels are angled outwardly (divergently) in a direction towards the distal ends of the arm or wrist brace (the direction toward the slingshot user). In this manner, the upper and lower channels generally track and complement the configuration of the distal ends of the arm or wrist brace which generally diverge in a rearward direction (the direction toward the user when the slingshot is in use).

Each of the upper and lower channels is formed with plurality of protuberances extending into or around the channel, which may be formed as nubs, lips or other members, configured to frictionally engage and secure the distal ends of the arm or wrist brace within the channels. In the disclosed embodiment, the tipper channels are disposed above the distal ends of the arm or wrist brace, white the lower channels are disposed below the distal ends of the arm or wrist brace, in this manner, the bail guard is securely affixed to the arm or wrist brace and cannot be inadvertently removed by the application of force in an upward or downward direction.

To affix the bail guard to the arm or wrist brace of a slingshot, the bail guard is inserted between the distal ends of the arm or wrist brace and rotated so the respective distal ends of the arm or wrist brace enter the respective grooves formed on opposing sides of the bail guard body. The bail guard, then is pivoted such that the respective distal ends of the arm or wrist brace enter the respective upper and lower channels of the bail guard. Pressure then is applied to force the distal ends of the arm or brace past the respective protuberances in the upper and lower channels such that the protuberances lock the distal ends into the upper and lower channels. To remove the bail guard, the steps are reversed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
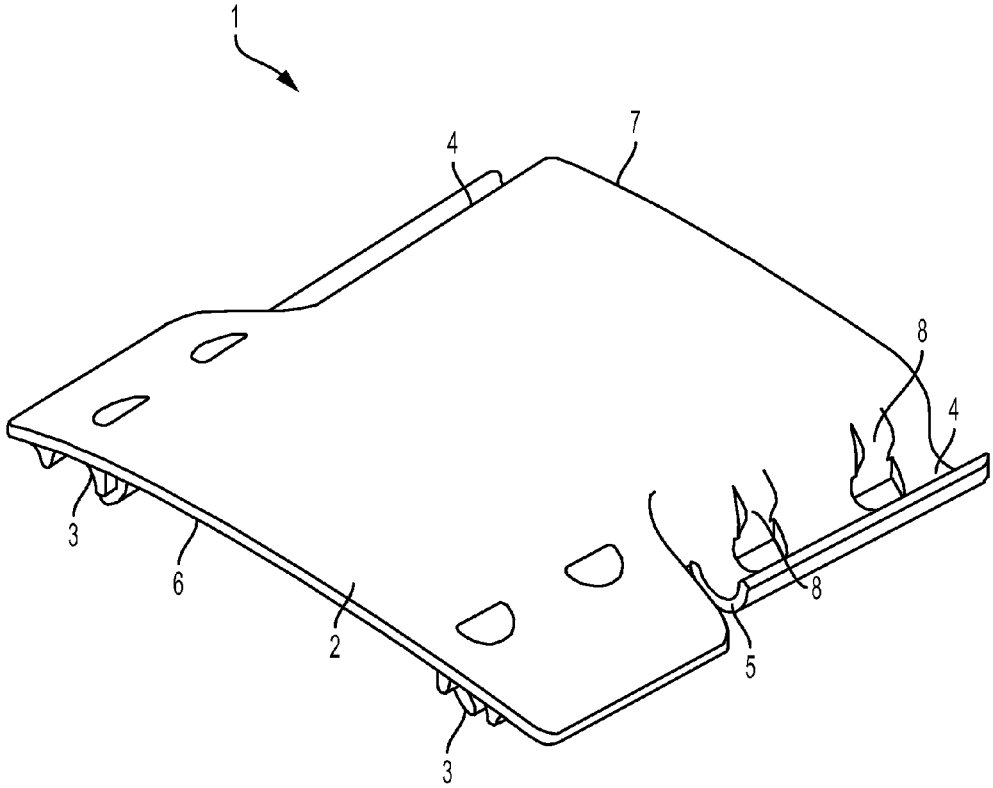
FIG. 1 is a perspective view of a slingshot bail guard embodying the principles of the present invention.
Figure 2:
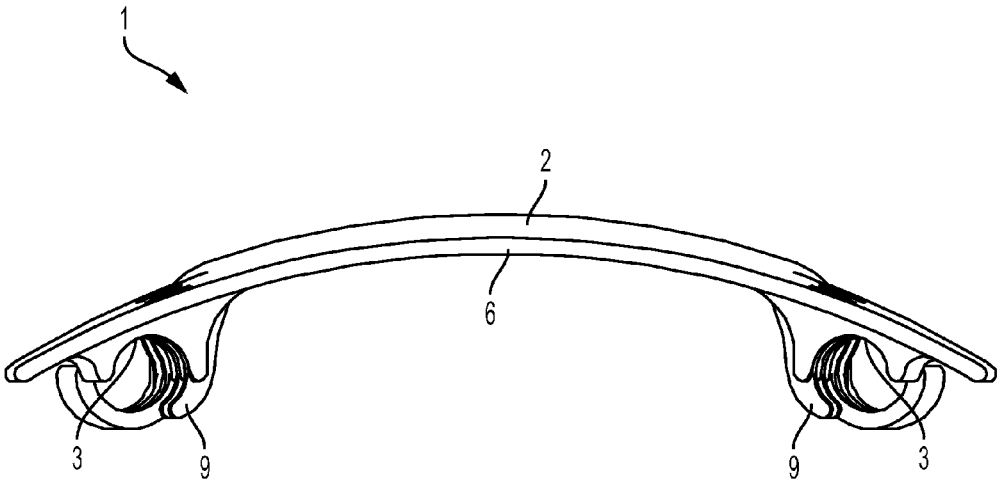
FIG. 2 is a front view of the slingshot bail guard of FIG. 1.
Figure 3:
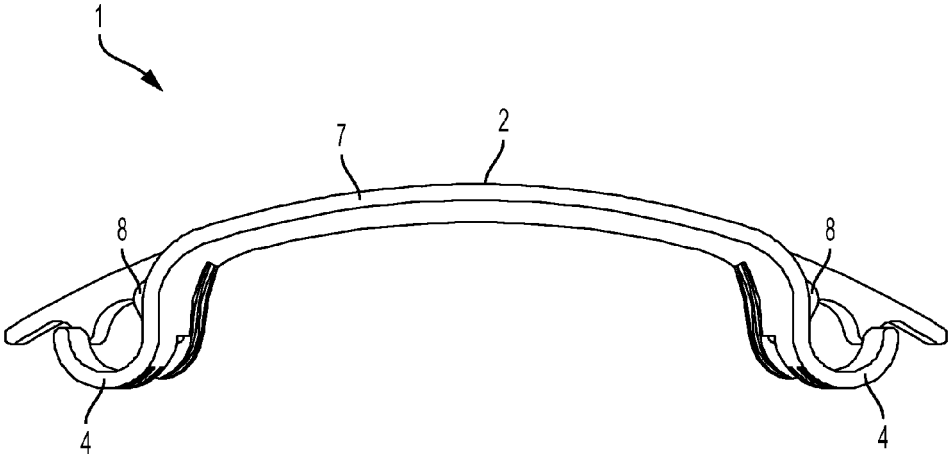
FIG. 3 is a back view of the slingshot bail guard of FIG. 1.
Figure 4:
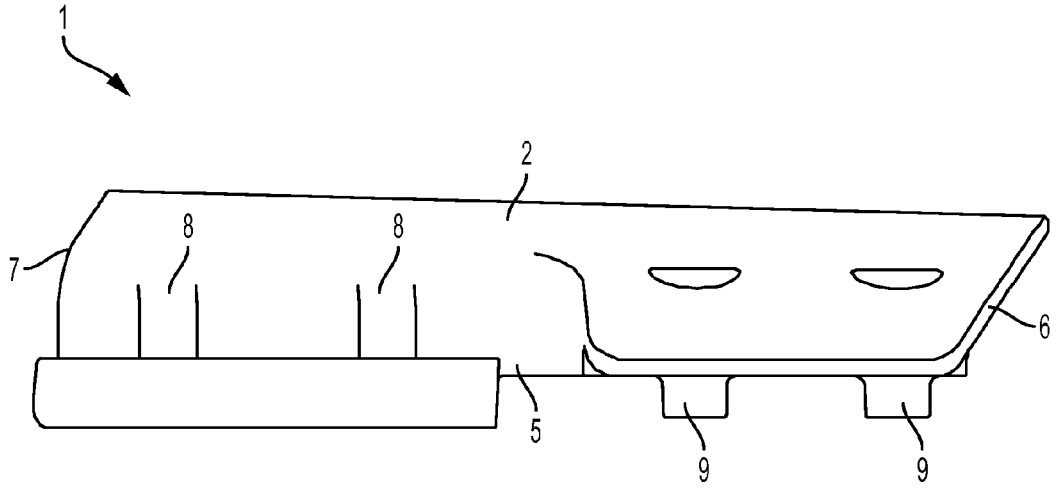
FIG. 4 is a left side view of the slingshot bail guard of FIG. 1.
Figure 5:
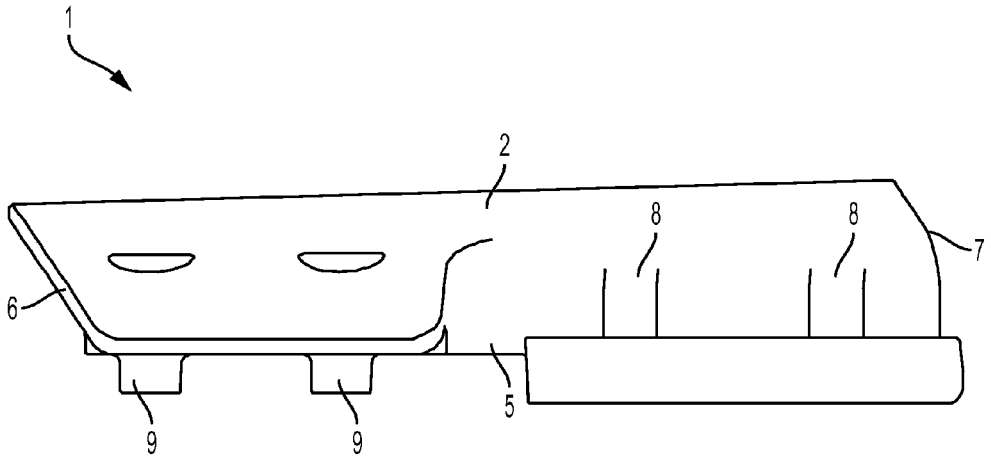
FIG. 5 is a right side view of the slingshot bail guard of FIG. 1.

While fire present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply; nor should be inferred to limit the subject matter disclosed herein.

FIGS. 1-18 illustrate the slingshot bail guard according to the principles of the present, invention. As an initial note, it will be appreciated that references in the instant disclosure to arm-braced slingshots include wrist-braced slingshots, and vice-versa. Thus, for ease of reference, the instant disclosure will refer to arm braces and arm-braced slingshots with the understanding that such terms also refer to wrist braces and wrist-brace slingshots.

As shown in FIGS. 1-7, the slingshot bail guard 1 of the present invention comprises a thin, slightly arcuate body 2 having upper channels 3 and lower channels 4 disposed on opposing sides of bail guard 1. In the preferred embodiment, bail guard 1 is formed of a molded plastic that is slightly flexible. However, those skilled in the art will, recognize that any lightweight, durable and sturdy material may be used, and all such materials are included within the scope of the instant disclosure.

Additionally, bail guard 1 may be formed in many different colors and shapes without, departing from the scope of the instant disclosure. That is, bail guard 1 may be made in a black color to complement a wide range of slingshots, or may be colored, for example, using a camouflage pattern if it is desired that bail guard 1 be less noticeable in outdoor environments. Similarly, bail guard 1 may be custom colored to suit a slingshot user's preference.

Additionally, while bail guard 1 is shown in FIGS. 1-7 has having generally curved upper edges 6 and lower edges 7, numerous different shapes of bail guard 1 are possible without departing front the scope of the present disclosure. For example, the upper edges 6 and lower edges 7 could be straight or could have a different profile. All such variations of bail guard 1 are included within the scope of the present disclosure.

As further shown in FIGS. 1-7, each upper channel 3 and lower channel 4 is separated by a groove 5. Grooves 5 preferably are dimensioned to have a width slightly greater than the diameter of the distal ends of the arm brace of the slingshot to which bail guard 1 will attach. That is, grooves 5 are shaped and sized to accommodate the distal ends of the arm brace of the slingshot. While the arm braces of many arm-braced slingshots have cylindrical (or rod-shaped) distal ends (having a circular profile), and the disclosed embodiment of bail guard 1 is formed such that grooves 5 can accommodate such a geometry, it will be appreciated by those skilled in the art that the distal ends of some arm braces may use different geometries (square, or rectangular, for example). To that end, grooves 5 may be sized and shaped as desired to accommodate such different geometries without departing from the scope of the instant invention.

Figure 10:
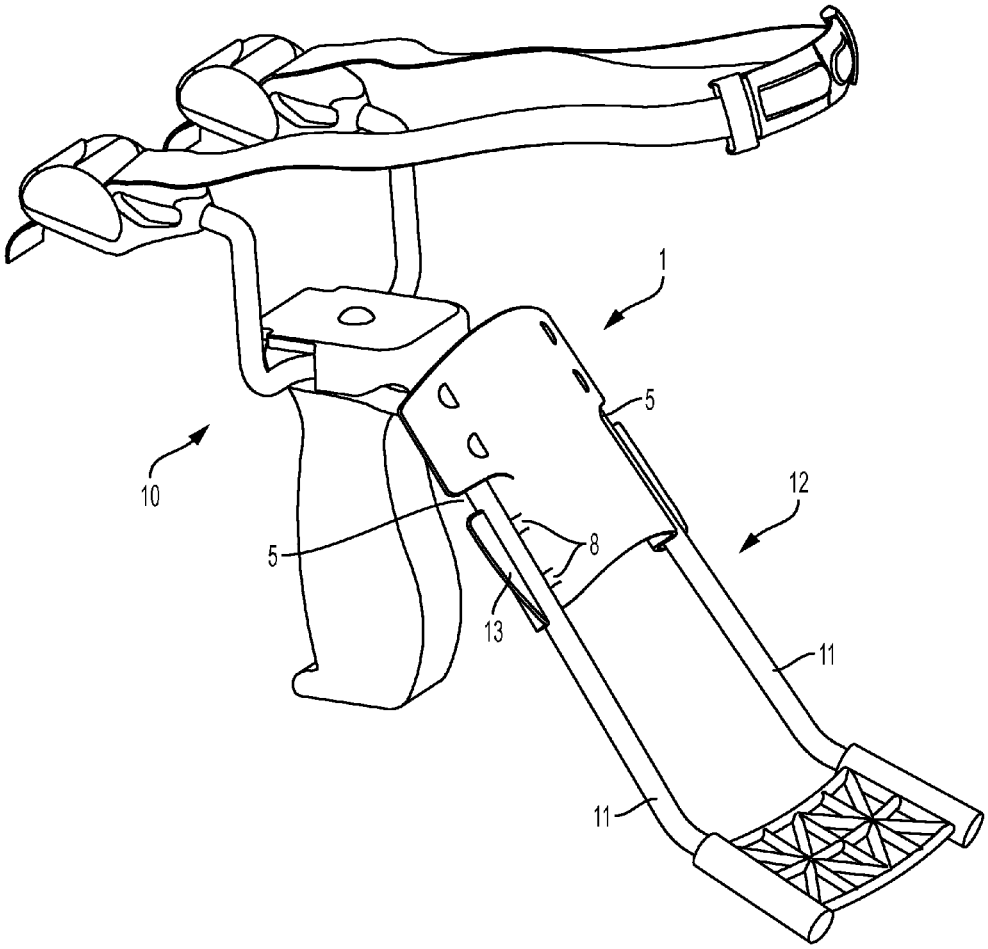
FIG. 10 is a perspective view showing the third step in attaching the slingshot bail guard of the present invention to a slingshot arm or wrist brace.
Figure 11:
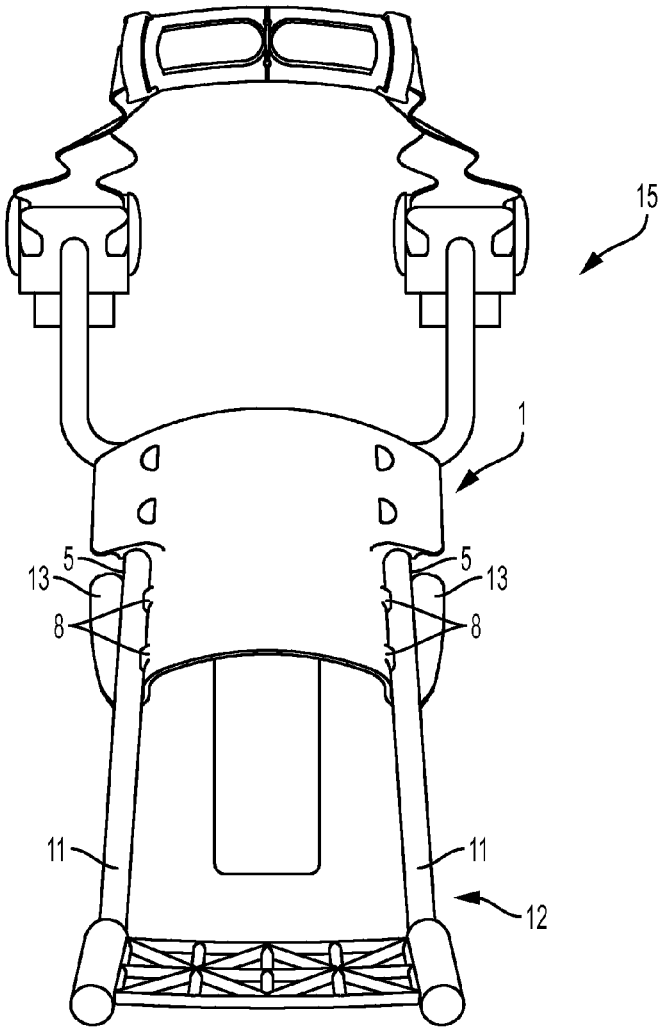
FIG. 11 is a rear view of a slingshot bail guard embodying the principles of the present invention attached to a first prior art slingshot.
Figure 12:
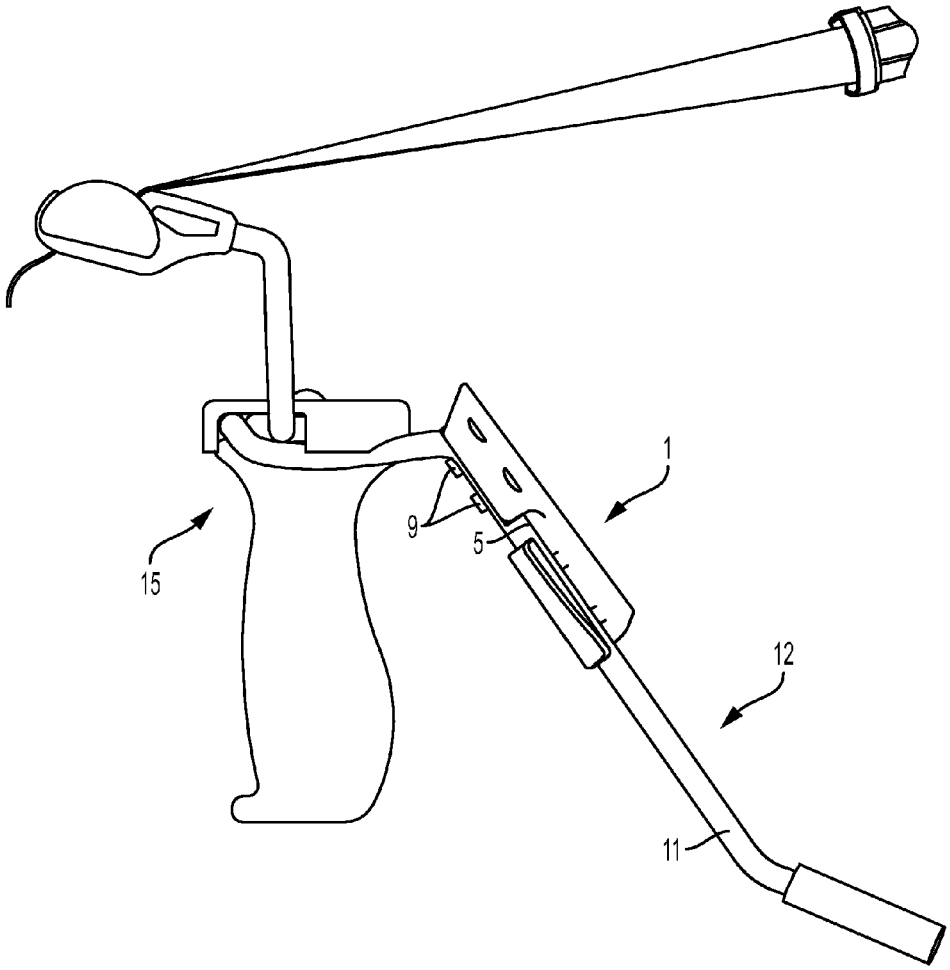
FIG. 12 is a side view of the slingshot bail guard and slingshot of FIG. 11.
Figure 13:
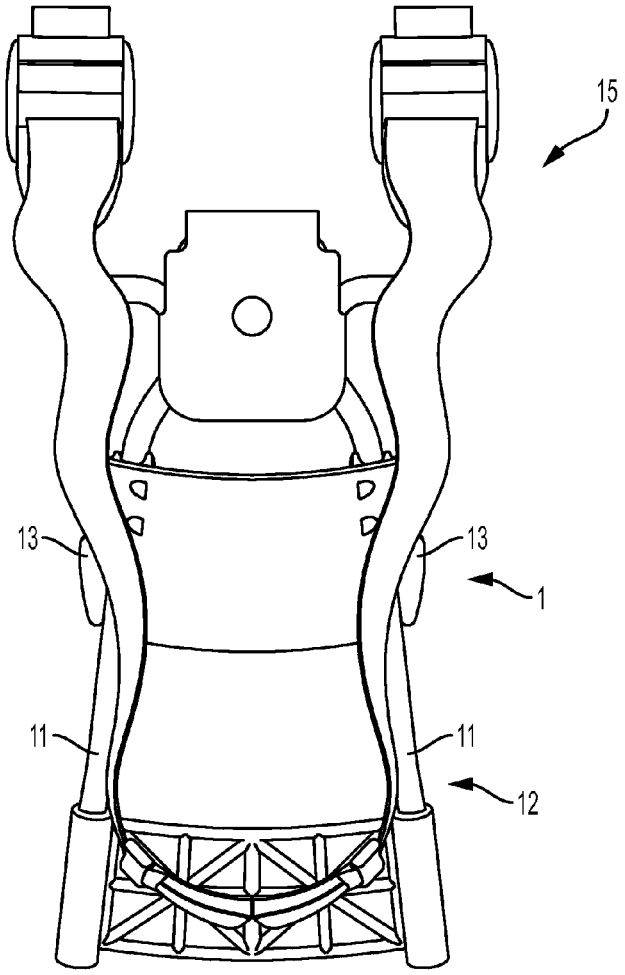
FIG. 13 is a top view of the slingshot bail guard and slingshot of FIG. 11.
Figure 14:
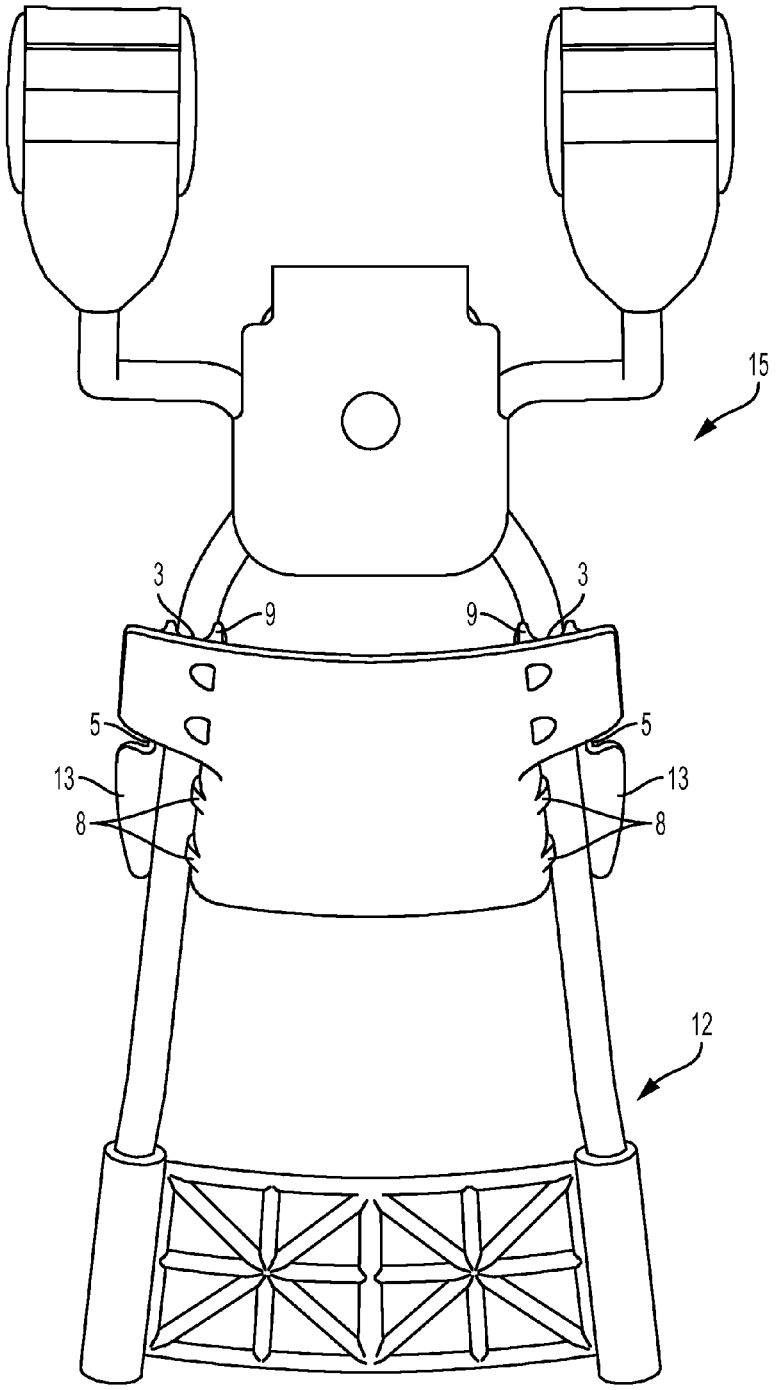
FIG. 14 is a top view of the slingshot bail guard and slingshot of FIG. 11 with the bands omitted.
Figure 15:
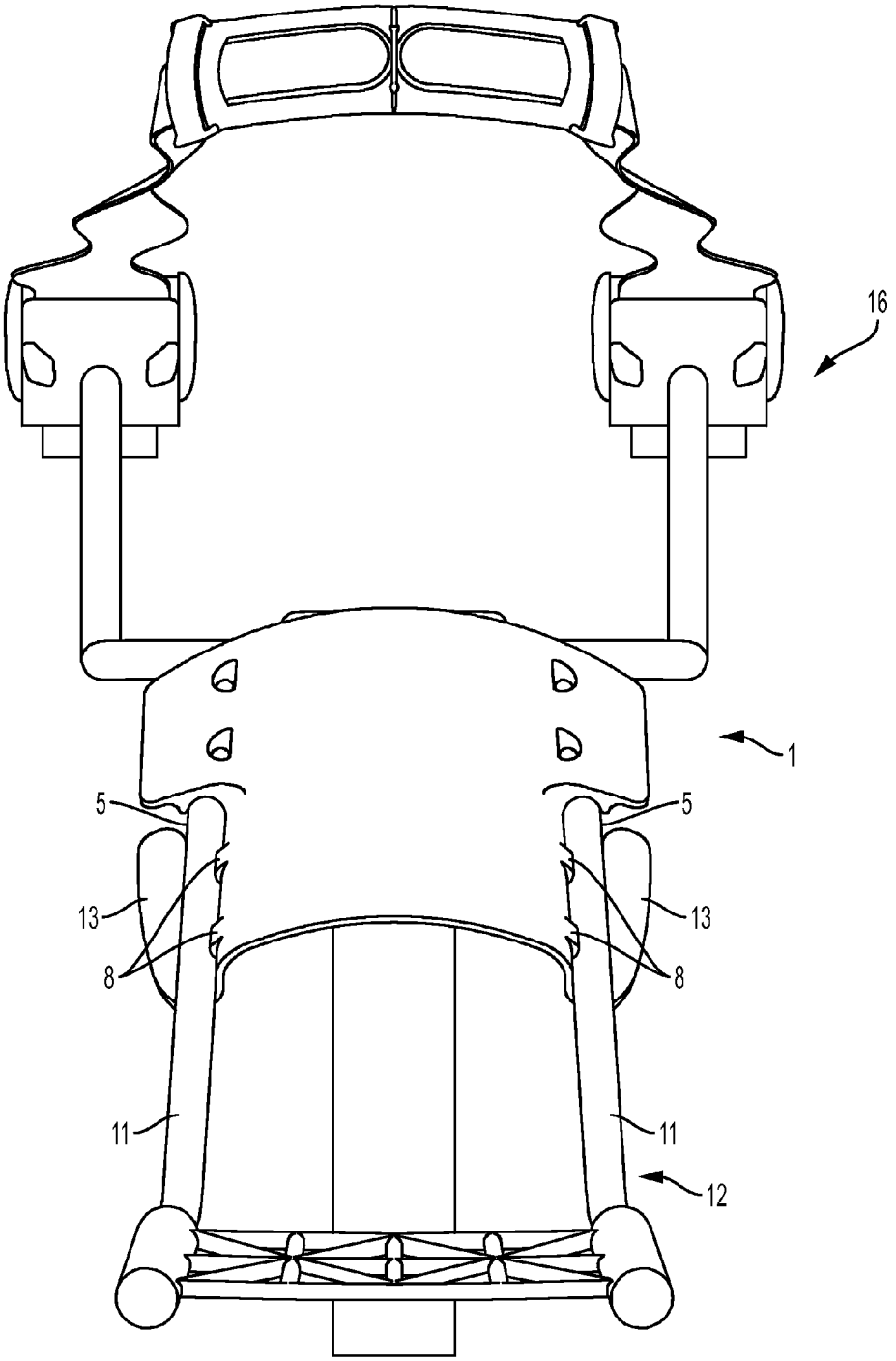
FIG. 15 is a rear view of a slingshot bail guard embodying the principles of the present invention attached to a second prior art slingshot.
Figure 16:
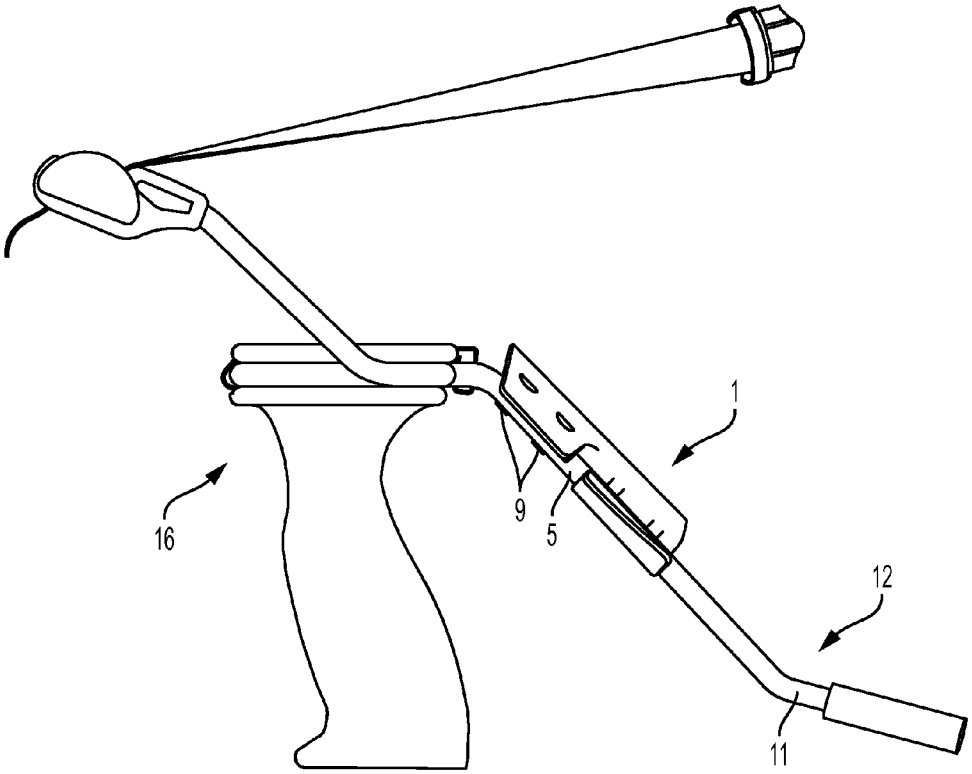
FIG. 16 is a side view of the slingshot bail guard and slingshot of FIG. 15.
Figure 17:
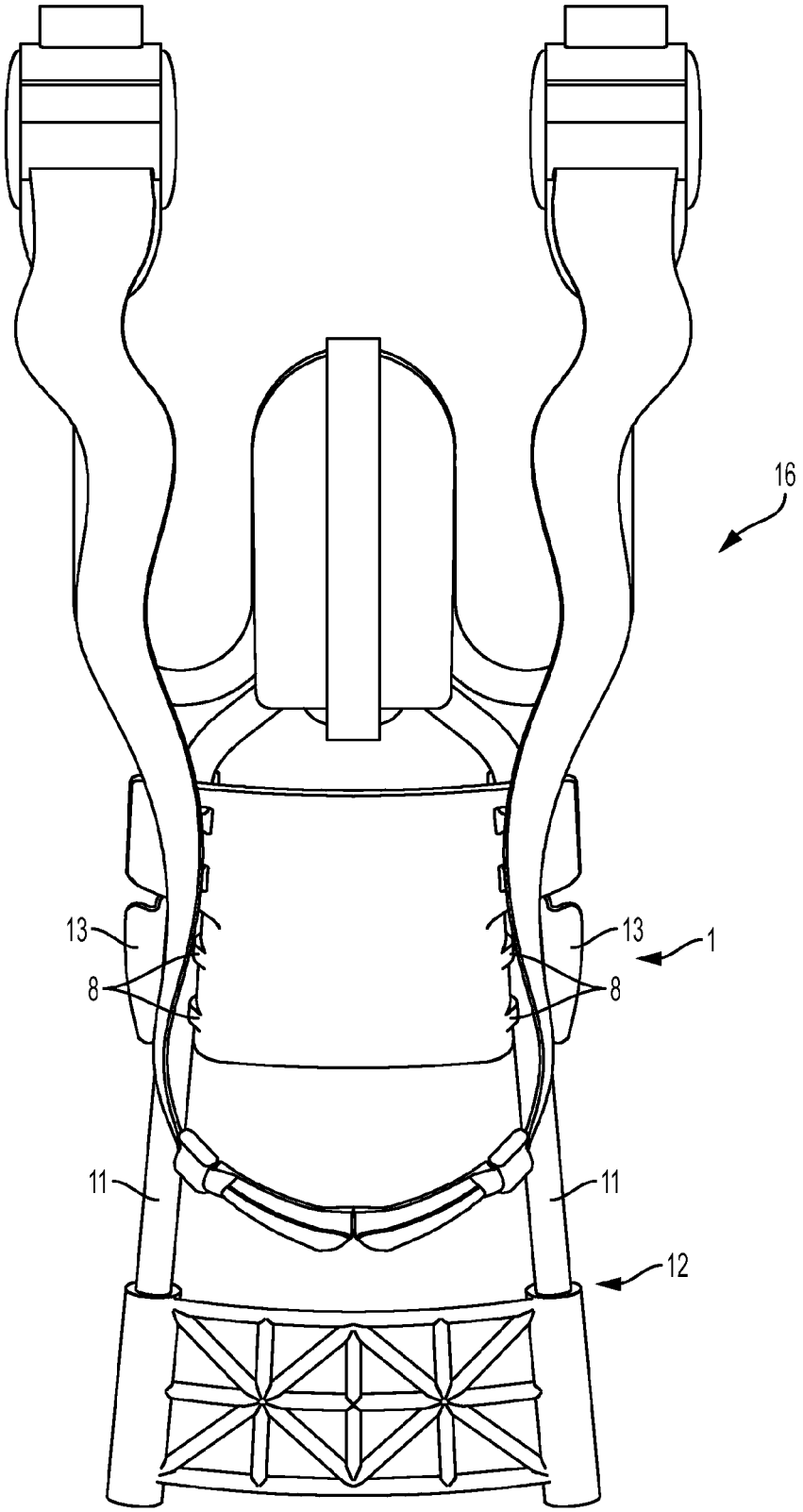
FIG. 17 is a top view of the slingshot bail guard and slingshot of FIG. 15; and, FIG. 18 is a top view of the slingshot bail guard and slingshot of FIG. 15 with the bands omitted.
Figure 18:
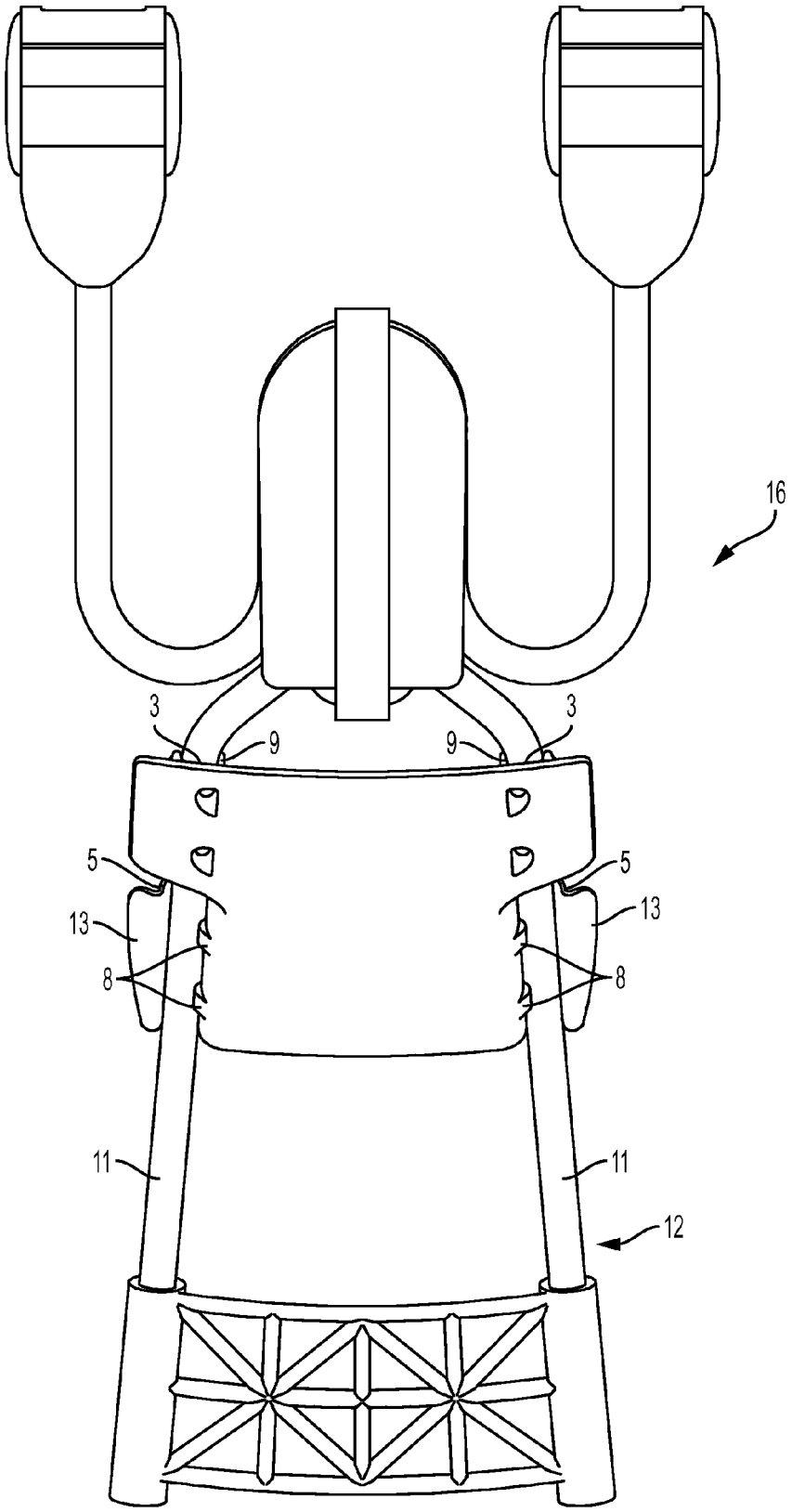

Similar to the dimensioning of grooves 5, upper channels 3 and lower channels 4 are dimensioned to receive and frictionally engage the distal ends of the arm brace of an arm-braced slingshot such that the bail guard 1 can be securely attached to the arm brace of the slingshot. It will be appreciated that bail guard 1 may be attached in any location along the distal ends of the arm brace as desired by a user. For example, as shown in FIG. 10, bail guard 1 is shown mounted to an upper portion of the distal ends (closer to the handle of the slingshot). Bail guard 1 may just as easily be mounted to a lower portion of the distal ends (closer to the arm strap) without departing from the scope of the present disclosure.

In the disclosed embodiment, as shown in FIGS. 1-7, upper channels 3 and lower channels 4 have a generally semi-circular profile, with a diameter approximately equal to the diameter of the distal ends of the arm brace of the slingshot. In this manner, the respective distal ends of the arm brace of the slingshot fit securely within respective upper channels 3 and respective lower channels 4, bail guard 1 being held in place in frictional engagement with protuberances formed in upper channels 3 and lower channels 4, as further discussed below.

As noted above, while the arm braces of many arm-braced slingshots have cylindrical (or rod-shaped) distal ends, and the disclosed embodiment of bail guard 1 includes upper channels 3 and lower channels 4 that are formed to accommodate such a geometry, it will be appreciated by those skilled in the art that the distal ends of some arm braces may use different geometries (square, or rectangular, for example). To that end, upper channels 3 and lower channels 4 may be sized and shaped as desired to accommodate such different geometries without departing from the scope of the instant invention.

As further shown in FIGS. 1-7, bail guard 1 is formed such that the respective upper channels 3, the respective lower channels 4 and the respective grooves 5 are disposed on opposing sides from one another of body 2 of bail guard 1. That is, upper channels 3 are opposite from one another across the width of body 2 of bail guard 1, grooves 5 are opposite from one another across the width of body 2 of bail guard 1 and lower channels 4 are opposite from one another across the width of body 2 of bail guard 1.

Those skilled in the art will recognize that other configurations are possible. For example, upper channels 3 and lower channels 4 may be staggered such a first upper channel 3 is disposed opposite a first lower channel 4, while a second upper channel 3 is disposed opposite a second lower channel 4. All such variations are included, within the scope of the instant disclosure.

Figure 6:
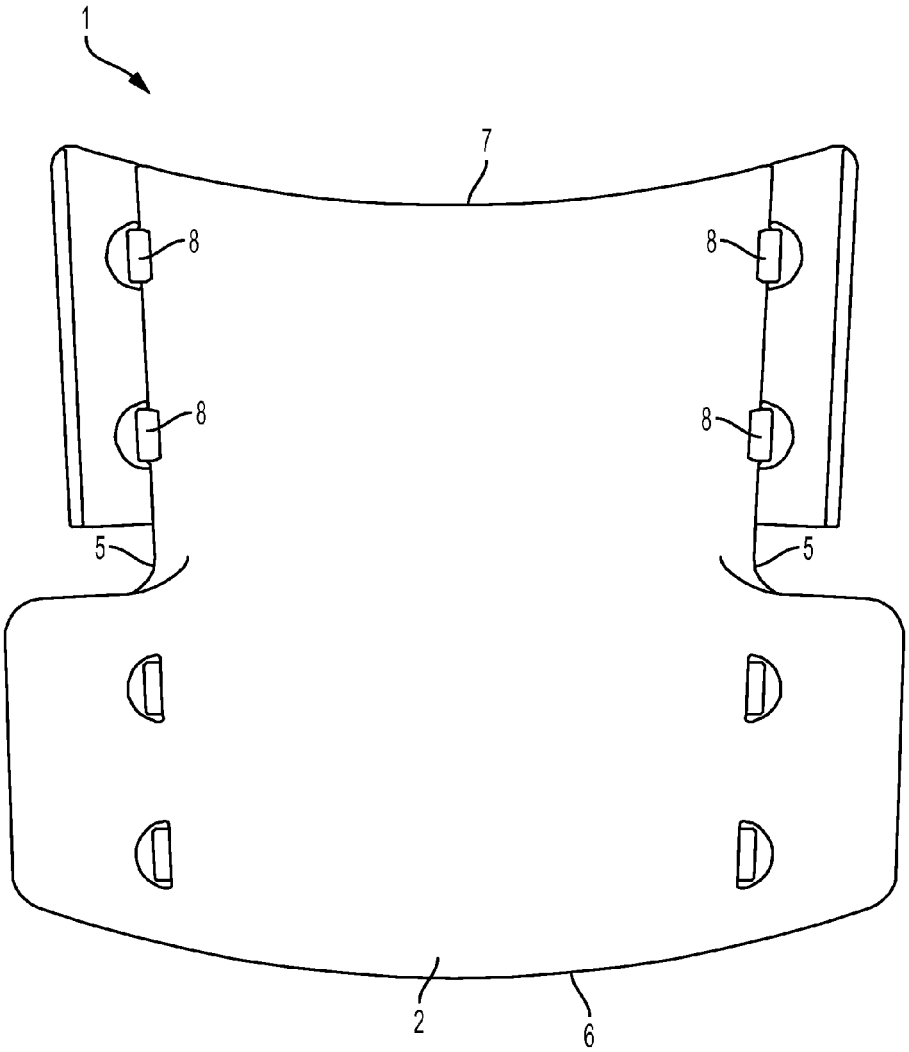
FIG. 6 is a top view of the slingshot bail guard of FIG. 1.
Figure 7:
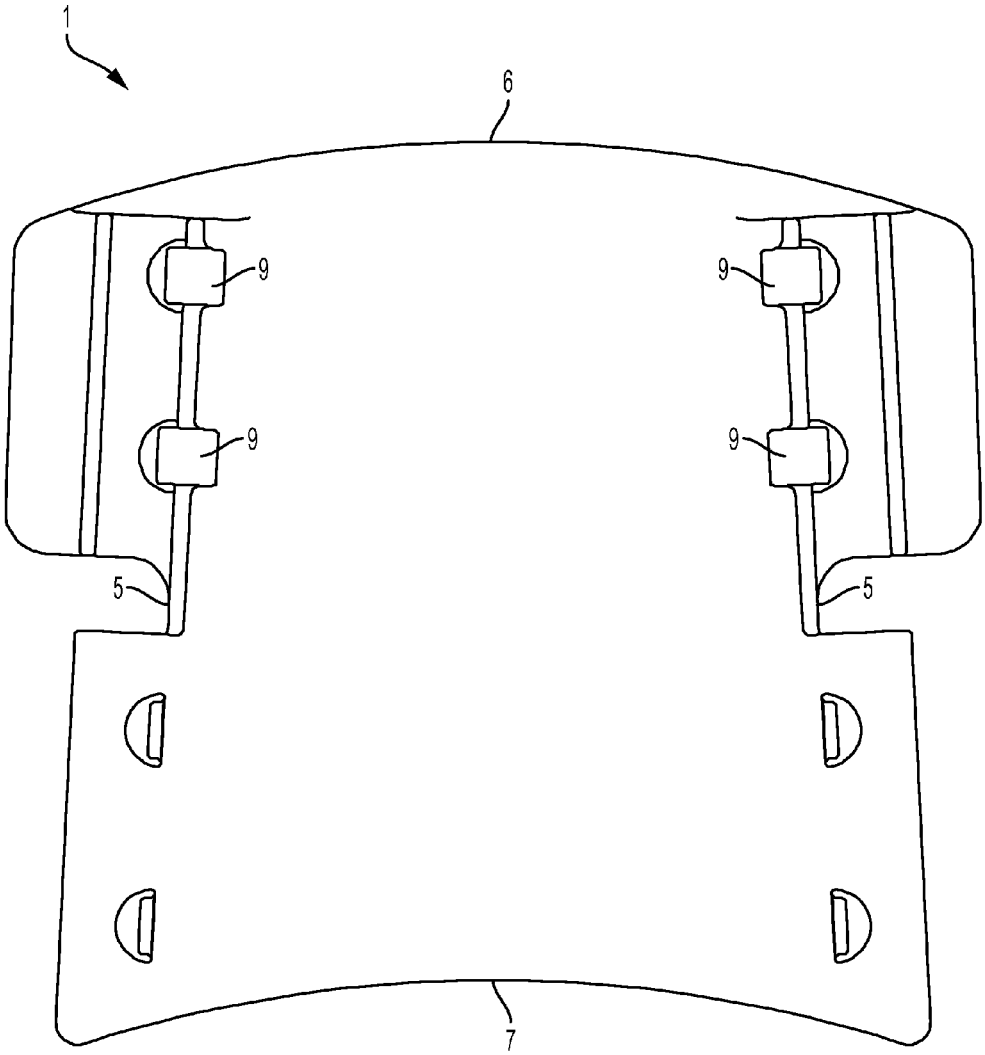
FIG. 7 is a bottom view of the slingshot bail guard of FIG. 1.

As seen most clearly in FIGS. 6-7, in the disclosed embodiment of slingshot bail guard 1 of the present invention, upper channels 3 and lower channels 4 are angled outwardly (or divergently) in a direction towards the distal ends of the arm brace (in a direction away from the slingshot handle and toward the slingshot user). In this manner, upper channels 3 and lower channels 4 generally complement and match the configuration and angular relationship of the respective distal ends of the arm brace which generally diverge from one another in a rearward direction (in a direction toward the user when the slingshot is in use).

However, those skilled in the art will recognize that in some prior art slingshots, the respective distal ends of the arm brace may be configured to be parallel to one another or to converge toward one another in a rearward direction (in a direction toward the user when the slingshot is in use). Thus, it will be appreciated that upper channels 3 and lower channels 4 may be configured accordingly to accommodate the particular configuration of the arm brace without departing from the scope of the present invention.

Each of the upper channels 3 and lower channels 4 is formed with plurality of protuberances extending into or around the channel, which may be formed as nubs, lips or other members, configured to frictionally engage and secure the distal ends of the arm brace within the channels. As most clearly shown in FIGS. 1-7, in the disclosed embodiment upper channels 3 are formed with a plurality of lips 9 that extend around upper channels 3. Lips 9 are configured to extend partially around the respective distal ends of the arm brace of the slingshot and frictionally engage the distal ends into upper channels 3.

In the disclosed embodiment, lips 9 are arcuate members designed to matingly engage the distal ends of the arm brace and securely retain the distal ends of the arm brace within upper channels 3. However, depending on the geometry of the distal ends (square, rectangular, etc.), lips 9 may be formed with a different profile to accommodate the particular geometry of the distal ends of the arm brace. All such variations in the profile of lips 9 are included within the scope of the instant disclosure.

As shown in FIGS. 1-7, in the disclosed embodiment of ball guard 1, lower channels 4 are formed with a plurality of nubs 8 that extend partially into lower channels 4. Nubs 8 are configured to extend partially around the respective distal ends of the arm brace of the slingshot and frictionally engage the distal ends into lower channels 4. Because nubs 8 extend around the respective distal ends of the arm brace of the slingshot to a lesser extent than lips 9, bail guard 1 may be readily attached and removed from the arm brace by exerting upward or downward pressure, as appropriate, on bail guard 1 in proximity to lower channels 4.

In the disclosed embodiment, nubs 8 are arcuate members have a rounded triangular profile configured to matingly engage the distal, ends of the arm brace and securely retain the distal ends of the arm brace within lower channels 4. However, depending on the geometry of the distal ends (square, rectangular, etc.), nubs 8 may be formed with a different profile to accommodate the particular geometry of the distal ends of the arm brace. All such variations in the profile of nubs 8 are included within the scope of the instant disclosure.

Figure 8:
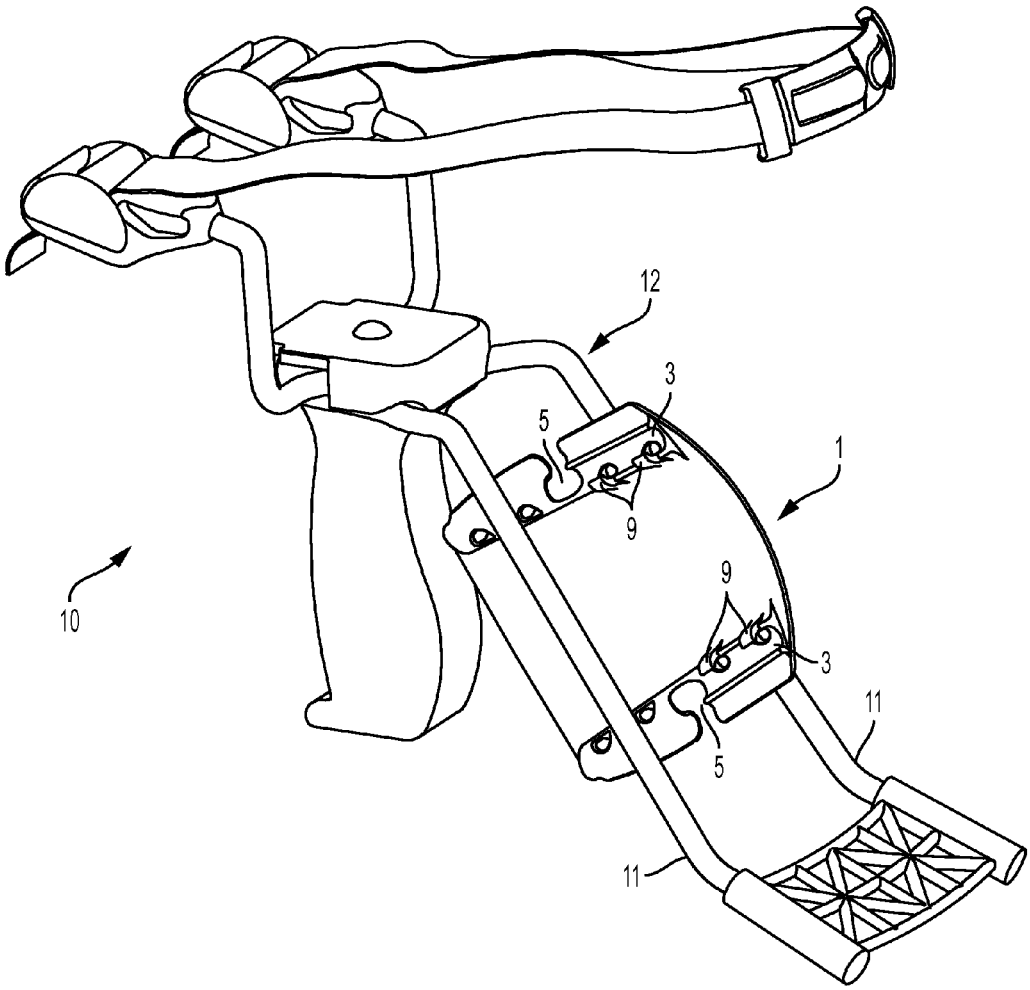
FIG. 8 is a perspective view showing the first step in attaching the slingshot bail guard of the present invention to a slingshot arm or wrist brace.
Figure 9:
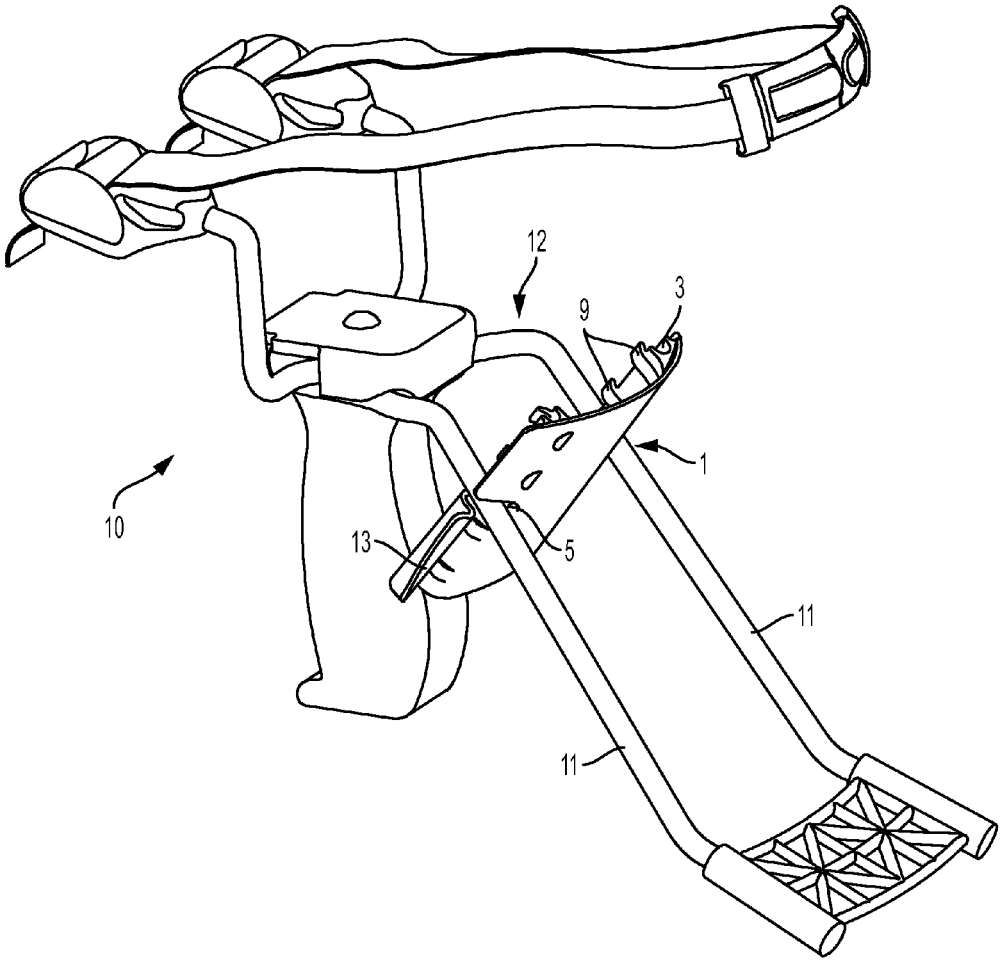
FIG. 9 is a perspective view showing the second step in attaching the slingshot bail guard of the present invention to a slingshot arm or wrist brace.

FIGS. 8-10 illustrate the steps to attach bail guard 1 to a slingshot 10. As discussed above, slingshot 10 comprises an arm brace 12 having a pair of distal ends 11. To attach bail guard 1 to arm brace 12, bail guard 1 is rotated in a position where upper channels 3 and lower channels 4 are perpendicular to distal ends 11 and positioned hi the opening between distal ends 11, as shown in FIG. 8.

Next, as shown in FIG. 9, bail guard 1 is rotated such that distal ends 11 are moved into engagement with grooves 5. Lastly, as shown in FIG. 10, bail guard 1 is pivoted while distal ends are disposed within grooves 5 such that distal ends are forced into frictional engagement with upper channels 3 and lips 9 and lower channels 4 and nubs 8, respectively. In this manner, bail guard 1 is securely affixed to arm brace 12.

To remove bail guard 1 from arm brace 12, pressure may be applied to outside wings 13 formed adjacent to lower channels 4, thereby disengaging distal ends 11 from frictional engagement with lower channels 4. The attachment process described above then is reversed to remove bail guard 1.

It will be appreciated by those skilled in the art that in the disclosed embodiment of bail guard 1, upper channels 3 are disposed above distal ends 11 of arm brace 12 when bail guard 1 is mounted to arm brace 12. Similarly, lower channels 4 are disposed below distal ends 11 of arm brace 12 when, bail guard 1 is mounted to arm brace 12. In this manner, bail guard 1 is securely affixed to arm brace 12 by the counter-balanced action of upper channels 3 and lower channels 4, and bail guard 1 cannot be inadvertently released by the application of force in an upward or downward directly on body 2 of bail guard 1.

It will be further appreciated by those skilled in the art that it is possible for upper channels 3 to be disposed below distal ends 11 of arm brace 12 when bail guard 1 is mounted to arm brace 12, and lower channels 4 to be disposed above distal ends 11 of arm brace 12 when bail guard 1 is mounted to arm brace 12, while providing a similar effect and without departing from the scope of the instant disclosure.

FIGS. 11-18 shown bail guard 1 according to the principles of the present invention as mounted to two different prior art slingshots. FIGS. 11-14 illustrate bail guard 1 as mounted to a first prior art slingshot 16, while FIGS. 14-18 illustrate bail guard 1 as mounted to a second prior art slingshot 16.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A slingshot bail guard, the bail guard comprising:

a slightly arcuate unitary body having a width;

a pair of upper channels formed on a first side of the body, the upper channels disposed opposite one another across the width of the body;

a pair of lower channels formed on a second side of the body, the lower channels disposed opposite one another across the width of the body;

a pair of grooves, the grooves formed in the body between the upper channels and the lower channels and disposed opposite one another across the width of the body, wherein the grooves are non-parallel to the upper and lower channels; and wherein the upper channels comprise a plurality of lips and the lower channels comprise a plurality of nubs.

2. The slingshot bail guard of claim 1 wherein the bail guard is formed of a molded plastic.

3. The slingshot bail guard of claim 1 wherein the bail guard is slightly flexible.

4. The slingshot bail guard of claim 1 wherein in the body further comprises a curved upper edge and a curved lower edge.

5. The slingshot bail guard of claim 1 wherein the grooves are dimensioned to accommodate an arm brace of a slingshot.

6. The slingshot bail guard of claim 1 wherein the upper channels and the lower channels are dimensioned to frictionally engage an arm brace of a slingshot.

7. The slingshot bail guard of claim 1 wherein the upper channels and the lower channels have a generally semi-circular profile.

8. The slingshot bail guard of claim 1 wherein the upper channels and the lower channels are angled outwardly from each other in a rearward direction.

9. The slingshot bail guard of claim 1 wherein the bail guard is removably attachable to an arm brace of a slingshot.

10. The slingshot bail guard of claim 1 wherein the first side of the body is opposite the second side of the body.

11. A slingshot bail guard, the bail guard comprising:

a unitary body having a width;

a pair of upper channels formed in the body, the upper channels disposed opposite one another across the width of the body and dimensioned to frictionally engage an arm brace of a slingshot;

a pair of lower channels formed in the body, the lower channels disposed opposite one another across the width of the body and dimensioned to frictionally engage the arm brace of the slingshot; and a pair of grooves, the grooves formed in the body and between the upper channels and the lower channels and disposed opposite one another across the width of the body, wherein the grooves are non-parallel to the upper and lower channels.

12. The slingshot bail guard of claim 11 wherein the upper channels comprise a plurality of lips and the lower channels comprise a plurality of nubs.

13. The slingshot bail guard of claim 11 wherein the body is arcuate.

14. The slingshot bail guard of claim 11 wherein the bail guard is formed of a molded plastic.

15. The slingshot bail guard of claim 11 wherein the bail guard is slightly flexible.

16. The slingshot bail guard of claim 11 wherein in the body further comprises a curved upper edge and a curved lower edge.

17. The slingshot bail guard of claim 11 wherein the grooves are dimensioned to accommodate the arm brace of the slingshot.

18. The slingshot bail guard of claim 11 wherein the upper channels and the lower channels have a generally semi-circular profile.

19. The slingshot bail guard of claim 11 wherein the upper channels and the lower channels are angled outwardly from each other in a rearward direction.

20. The slingshot bail guard of claim 11 wherein the bail guard is removably attachable to the arm brace of the slingshot.

* * * * *

UNITED STATES PATENT AND TRADEMARK OFFICE

CERTIFICATE OF CORRECTION

PATENT NO. : 9,038,615 B2
APPLICATION NO. : 13/850023
DATED : May 26, 2015
INVENTOR(S) : Charles A. Saunders It is certified that error appears in the above-identified patent and that said Letters Patent is hereby corrected as shown below:

On the Title Page, item (57) abstract, column 2, line 6, "fictionally" to read as --frictionally--.

In the Specification

Column 2, line 9, "guard," to read as --guard--.

Column 2, line 13, "disposed," to read as --disposed--.

Column 2, line 26, "bail," to read as --bail--.

Column 2, line 43, "brace, in" to read as --brace. In--.

Column 2, line 51, "guard," to read as --guard--.

Column 3, line 54, "imply;" to read as --imply,--.

Column 3, line 57, "present," to read as --present--.

Column 4, line 2, "will," to read as --will--.

Column 4, line 7, "without," to read as --without--.

Column 4, line 18, "front" to read as --from--.

Column 5, line 18, "included," to read as --included--.

Column 6, line 6, "distal," to read as --distal--.

Column 6, line 18, "hi," to read as --in--.

Signed and Sealed this
Tenth Day of November, 2015

Michelle K. Lee

Michelle K. Lee
*Director of the United States Patent and Trademark Office*